US005727958A

United States Patent [19]

Chen

[11] Patent Number: 5,727,958

[45] Date of Patent: Mar. 17, 1998

[54] SLIDABLE SPRING ACTUATED GUARD LID FOR HOUSEHOLD SOCKET SET

[76] Inventor: Chien-Ming Chen, 4Fl. No. 6, Lane 6, Alley 75, Lian-Chen Road, Chung-Ho City, Taipei Hsien, Taiwan

[21] Appl. No.: 695,895

[22] Filed: Aug. 12, 1996

[51] Int. Cl.[6] ..... H01R 13/44

[52] U.S. Cl. ..... 439/136; 174/67; 439/139; 439/142

[58] Field of Search ..... 174/67; 220/242; 439/142, 143, 145, 136

[56] References Cited

U.S. PATENT DOCUMENTS 4,793,818 12/1988 Poirier ..... 439/136
4,867,694 9/1989 Short ..... 439/145
5,011,419 4/1991 Maan ..... 439/145
5,107,075 4/1992 Currier, Jr. ..... 439/136

*Primary Examiner*—Neil Abrams
*Assistant Examiner*—Barry M. L. Standig
*Attorney, Agent, or Firm*—Pro-Techtor International

[57] ABSTRACT

A telescopic guard lid for use on a household wallplate socket set has telescopic door plates interconnected to one another and the front door plate is engaged with a bias spring so that the guard lid can be forced opened to permit a plug to be inserted into a socket and be retractablly shut when the inserted plug is withdrawn. This guard lid can also be designed to be pivotally opened or closed piece by piece and be retained in a closed position by way of magnetic force.

4 Claims, 7 Drawing Sheets

SLIDABLE SPRING ACTUATED GUARD LID FOR HOUSEHOLD SOCKET SET

BACKGROUND OF THE INVENTION

The present invention relates to an improved guard lid applied to a common household wall-mounted socket set for protection of the socket set in a bathroom or any place from getting wet by water that splashes into a socket via its plugging holes, easily causing electrical shock by accident in operation. The guard lid of the present invention is telescopically extended and concealed automatically or manually when a plug is plugged into a socket or pulled out of the socket. The guard lid can also be pivotally operated and locked in position by way of a magnet.

Conventional socket sets are usually not provided with a guard lid at all, as shown in FIG. 1. Such simple prior-art wall-mounted socket set is made up of an outer cover 1, a fixing seat 12 for the outer cover 1, a bracket 13. There is a retaining hook 11 disposed at each corner of the outer cover 1 and it can be engaged with a corresponding hole 16 disposed at each corner of the fixing seat 12. A pair of sockets 14 having plugging holes 141 are exposed via two holes 15 of the outer cover 1 when the outer cover 1 is engaged with the fixing seat 12 so that plugs can be applied to the socket set.

Such prior art has a number of disadvantages in practical operation. The exposed sockets 14 easily get wet by splashed water in a bathroom via the plugging holes 141, and a person with wet bare feet comes into contact with the socket sets can get fatally electrically shocked. Additionally, the exposed sockets can easily get dusty and not function as a result of poor electrical contact. Moreover, the exposed sockets can attract a child's interest and cause injury when the child plugs metal wires or conductive articles into the socket.

SUMMARY OF THE INVENTION

The primary object of the present invention is to provide a telescopic guard lid that is made up of a number of interconnected door plates 25, 26, 27 for use on a common socket set so that splashed water can be stopped from accidentally coming into sockets disposed in a bathroom, causing an electrical shock. The guard lid assembly can be secured to a common household wall-mounted socket set with ease.

Another object of the present invention is to provide a retractable telescopic guard lid for use on a common socket set, that can automatically cover the socket holes when a plug is removed.

One further object of the present invention is to provide a pivotally operated guard lid that can either be pulled opened or shut manually and it can be retained in a locking position by way of magnetic force.

DETAILED DESCRIPTION OF THE PREFERRED EMBODIMENTS

Figure 1:
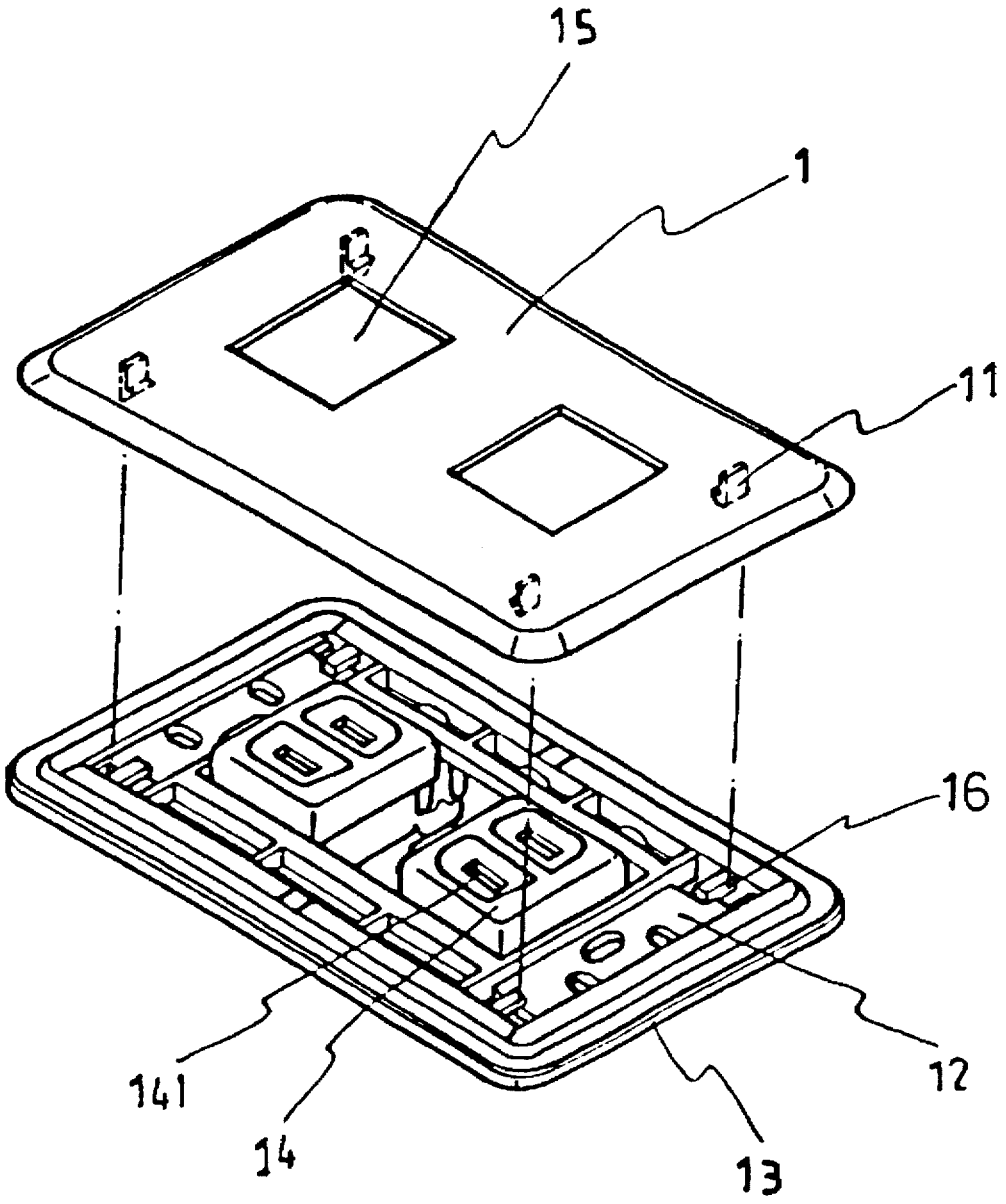
FIG. 1 PRIOR ART
FIG. 1 is a perspective diagram showing a prior art socket set without a guard lid.
Figure 2:
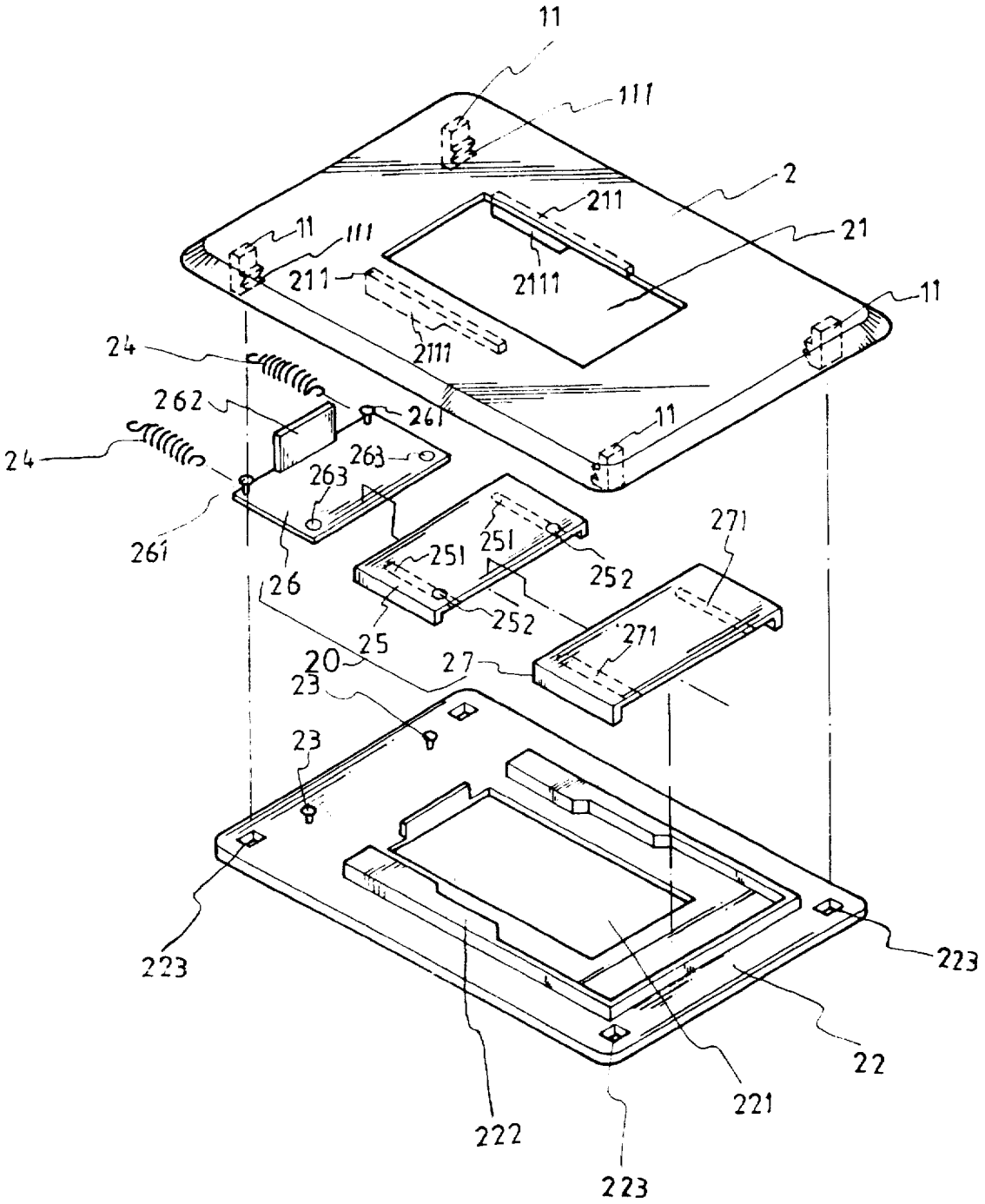
FIG. 2 is a perspective diagram showing the exploded components of a first embodiment of the present invention.

Referring to FIG. 2, a guard lid of the first embodiment of the present invention is comprised of a top cover 2 having a central opening 21, a guard lid 20 and a bottom board 22 having a central hole 221 defined in corresponding alignment with the central opening 21 of the top cover 2.

On the underside of the top cover 2 and on each long side of the rectangular central opening 21 is disposed a retaining block 211 which has a downward extension 2111. At each corner of the underside of the top cover 2 is also disposed a locking hook 11 having a hooking end 111. The guard lid 20 is made up of a front door plate 26, a middle door plate 25 and a rear door plate 27 that are telescopically connected to one another.

The front door plate 26 has two fixing posts 261 each disposed at each corner of one side thereof with a vertical holding wall 262' located therebetween. At each corner of the opposite side of the wall 262 is disposed a protruded dot 263. To each of the fixing post 261 is secured a bias spring 24. On the underside of the middle door plate 25 are disposed a pair of parallel grooves 251. At each corner of one long side of the middle door plate 25 and on the top surface thereof is disposed a protruded dot 252. There are two parallel grooves 271 defined on the underside of the rear door plate 27 and disposed in linear alignment with the grooves 251 of the middle door plate 25.

The bottom board 22 having a central hole 221 has a 3-sided wall 222 disposed about the central hole 221 thereof. At each corner of the bottom board 22 is disposed a locking cavity 223. On one short side of the bottom board 22 and between the two locking cavities 223 are disposed a pair of fixing posts 23 for the securing of the end of the bias springs 24.

The front door plate 26, the middle door plate 25 and the rear door plate 27 are confinedly located in the 3-sided wall 222 having two parallel sides thereof defined telescopically. The front door plate 26 is movably limited by the downward extension 2111 of the retaining block 211 so that it will not disengage from the top cover 2 during assembly. The rear door plate 27 is wider than both the middle door plate 25 and the front door plate 26 and the middle door plate 25 is in turn wider than the front door plate 26 so that the three door plates can be telescopically connected together.

In operation, the protruded dots 263 of the front door plate 26 are in slidable engagement with the parallel grooves 251 of the middle door plate 25 and the protruded dots 252 of the middle door plate 25 in turn are in slidable engagement with the parallel grooves 271 of the rear door plate 27. Moreover, the three differently sized door plates 26, 25 and 27 are moved in a limiting manner in the parallel stepwise sides of the three-sided wall 222. The top cover 2 is locked to the bottom board 22 by snapping the locking hooks 11 of the top cover 2 into engagement with the locking cavities 223 of the bottom board 22.

Figure 2A:
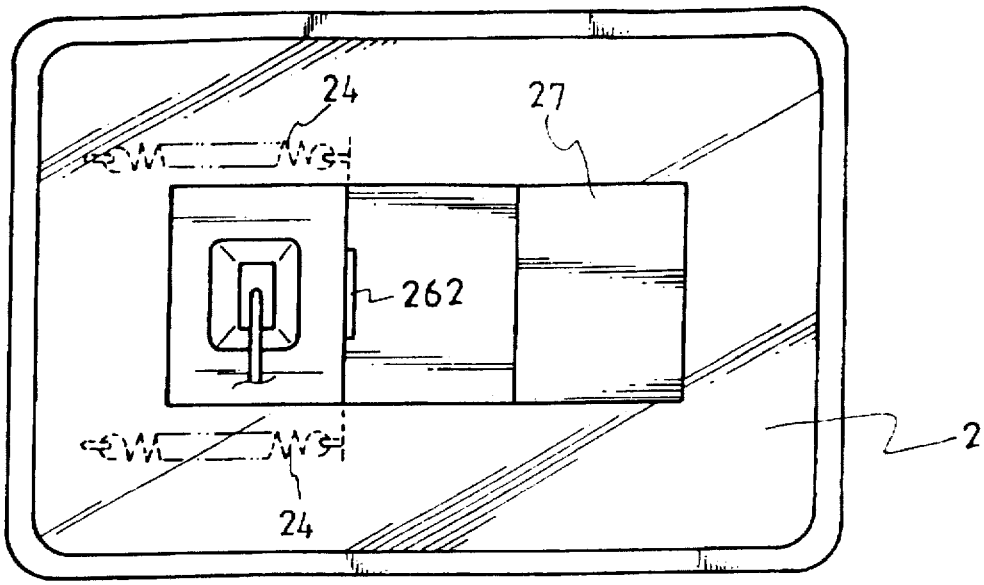
FIG. 2A is a diagram showing the guard lid is forced open and a plug is inserted into the socket.
Figure 2B:
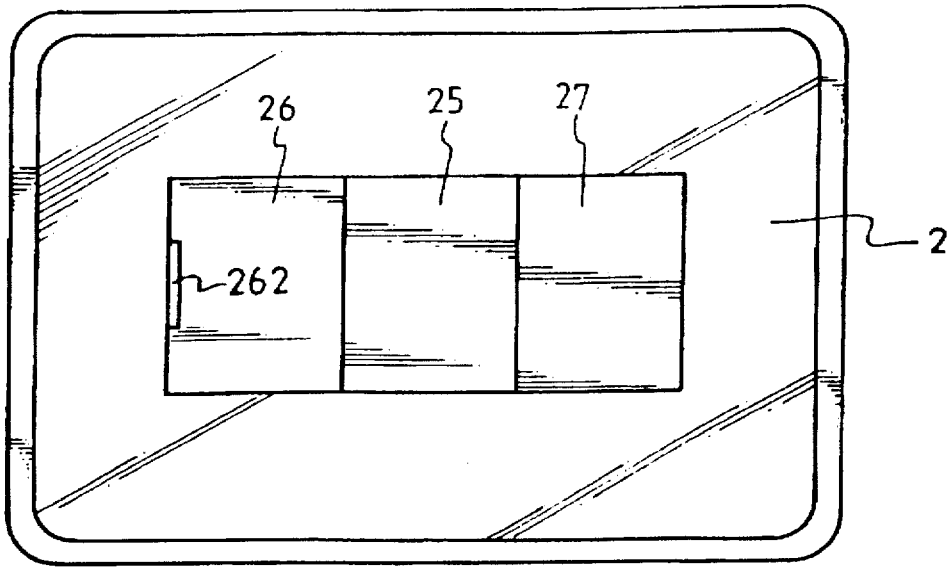
FIG. 2B is a diagram showing the guard lid is automatically shutting when the plug is withdrawn.

The bias springs 24 each having one end secured to one fixing post 261 of the front door plate 26 and the other end fixed to one fixing post 23 of the bottom board 22 whereby the front door plate 26 which can push both the middle door plate 25 and the rear door plate 27 aside when a plug (not shown) is to be plugged into a socket and the door plates can be automatically relocated when an inserted plug is disengaged so that the socket set is closed by the telescopic guard lid 20, as clearly shown in FIGS. 2A, 2B.

When the top cover 2 is in locking engagement with the bottom board 22 with the locking hooks. 11 engaged with the locking cavities 223 and the hooking ends 111 partially sticking out so that the assembled top cover 2 and the telescopic guard lid 20 and the bottom board 22 can be easily attached to a common wall-mounted socket set by removing the outer cover 1 and get the hooking ends engaged with the typical fixing seat 12 of a prior art socket set. It is rather convenient for the replacement or installation of the present invention in practice.

Figure 3:
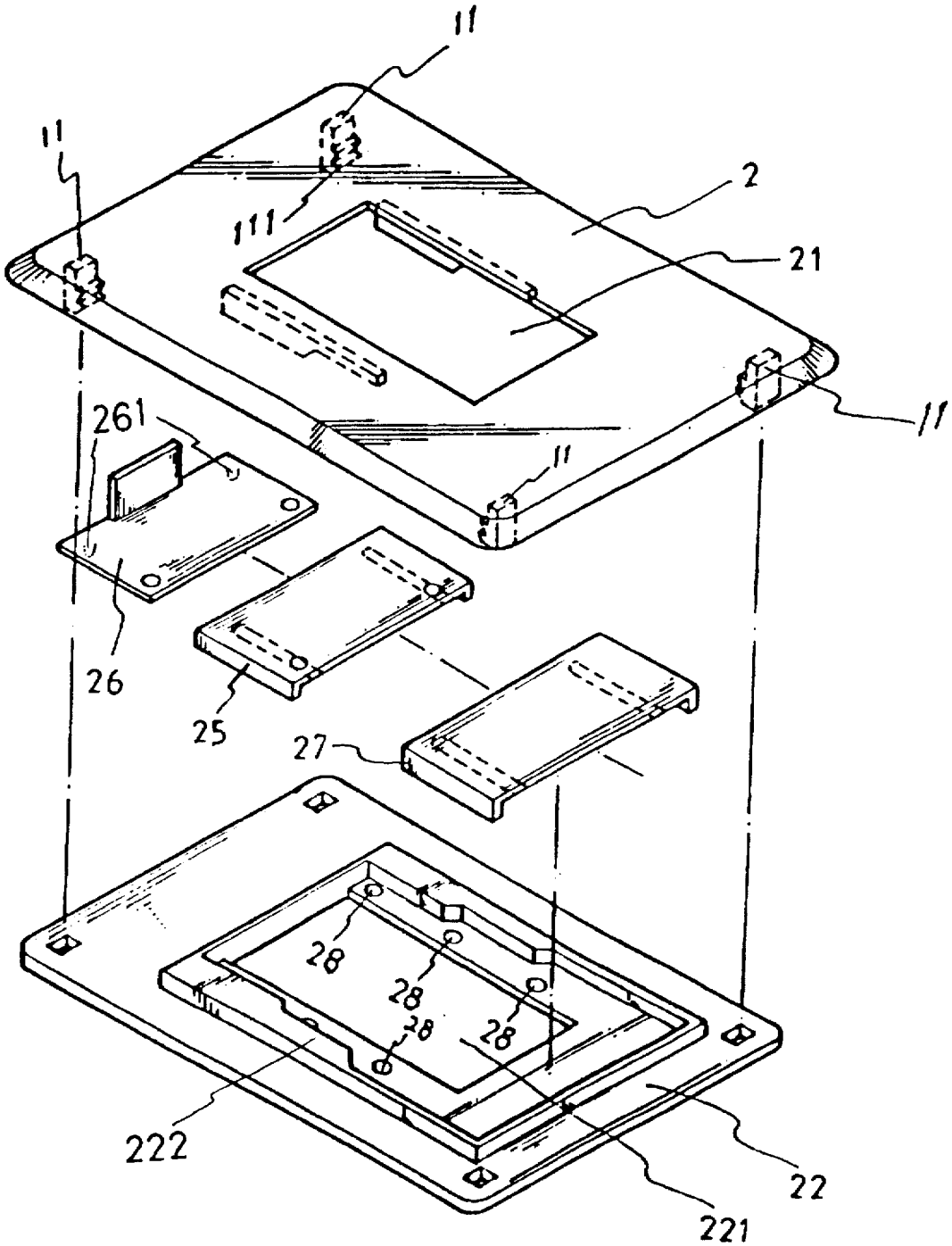
FIG. 3 is a perspective diagram showing the exploded components of a second embodiment thereof.

In a second embodiment, as shown in FIG. 3, the front door plate 26 is additionally provided with a pair of projections 261 on the underside thereof. There are three spaced cavities 28 disposed on each long side of the central hole 221 of the bottom board 22 adjacent the three-sided wall 222 so that the front door plate 26 can be pulled outwardly or pushed inwardly and be retained in place by way of the projections 261 engaged with the corresponding cavities 28.

Figure 4:
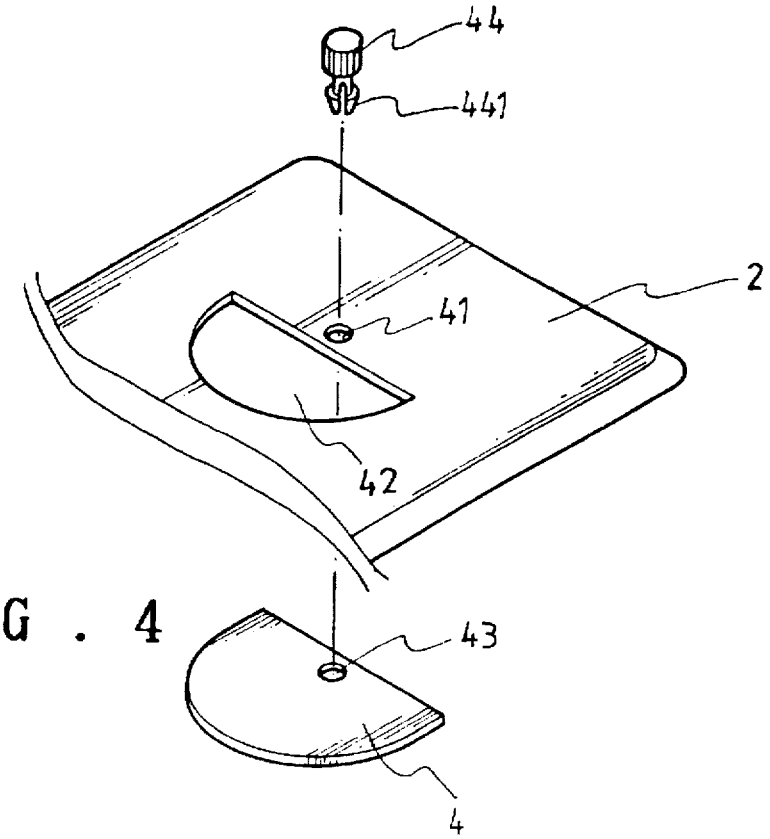
FIG. 4 is a diagram showing a third embodiment of the present invention.
Figure 4A:
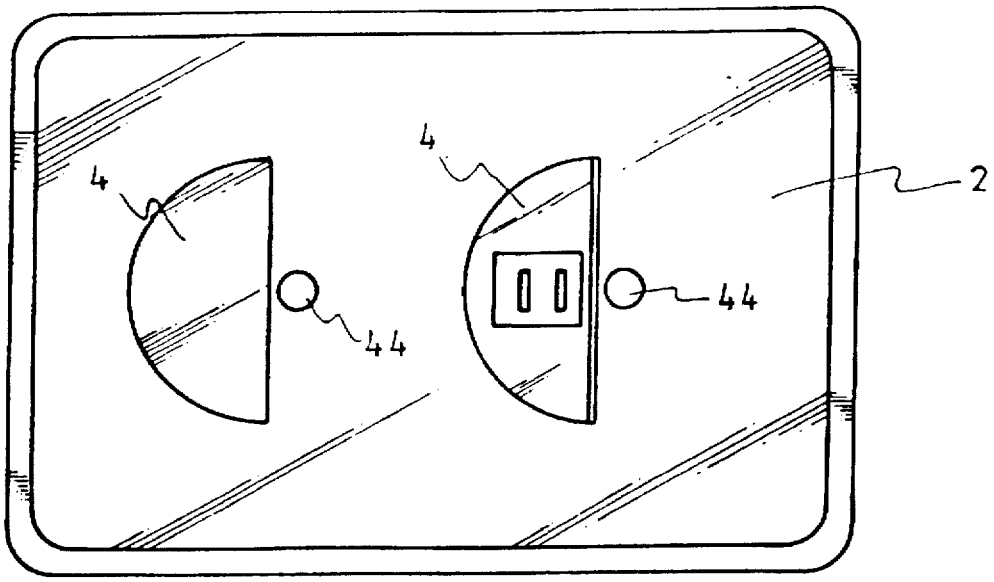
FIG. 4A is a diagram showing the opened and closed state of the socket set illustrated in FIG. 4.

As in the third embodiment shown in FIGS. 4, 4A, the guard lid 20 can be defined in a semi-circular plate 4 having a through hole 43 defined on the linear side thereof. The top cover 2 is provided with a semi-circular opening 42 and is also provided with a through hole 41 at the middle of the linear side of the opening 42. A retaining knob 44 having a locking hook 441 is snapped into the hole 41 and the hole 43 and is firmly engaged with the plate 4. The semi-circular plate 4 is slightly larger than the semi-circular opening 42 so that the turning of the retaining knob 44 can cause the plate 4 to open or shut alternatively, as shown in FIG. 4A.

Figure 5:
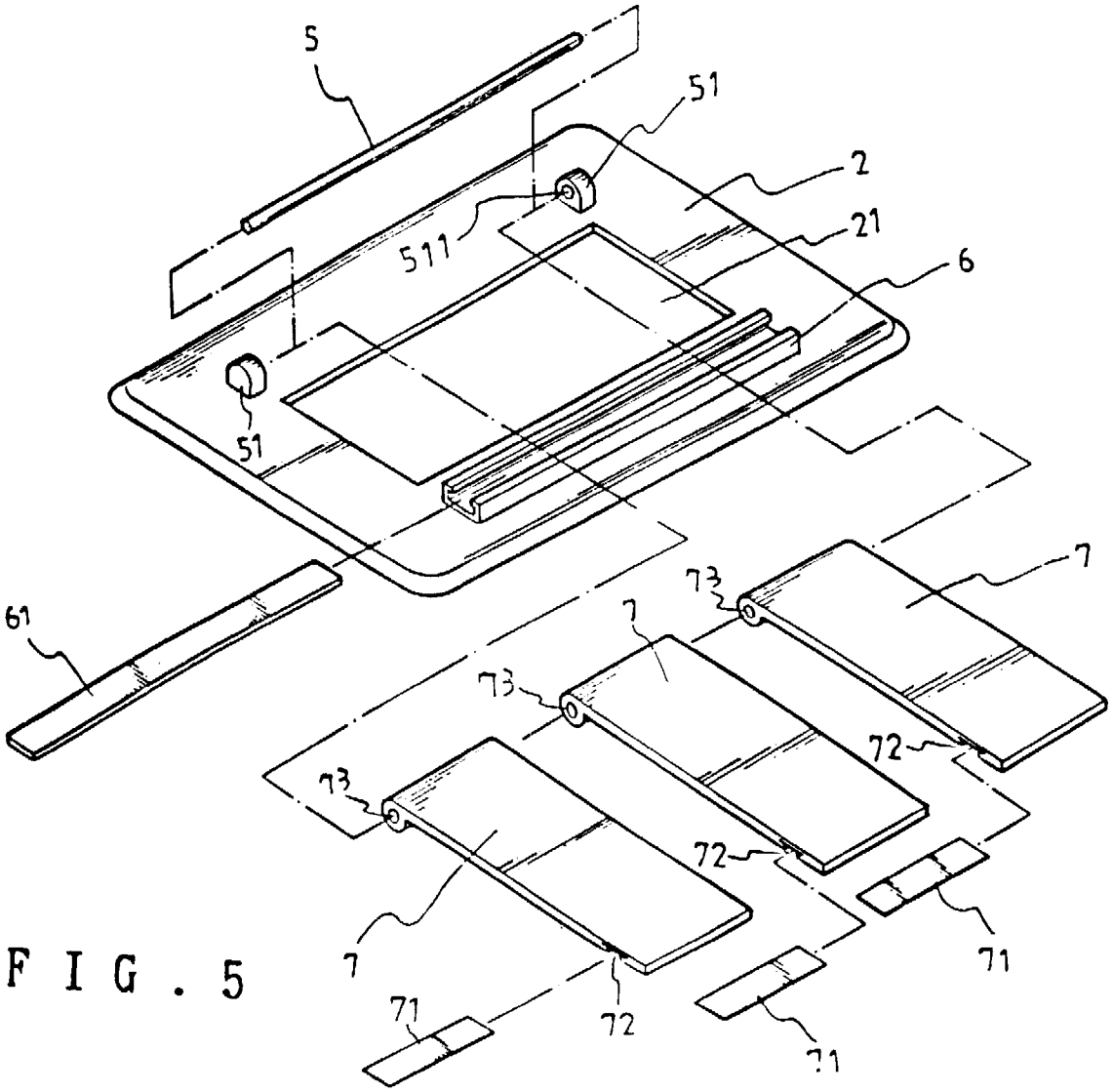
FIG. 5 is a diagram showing a fourth embodiment of the present invention.
Figure 5A:
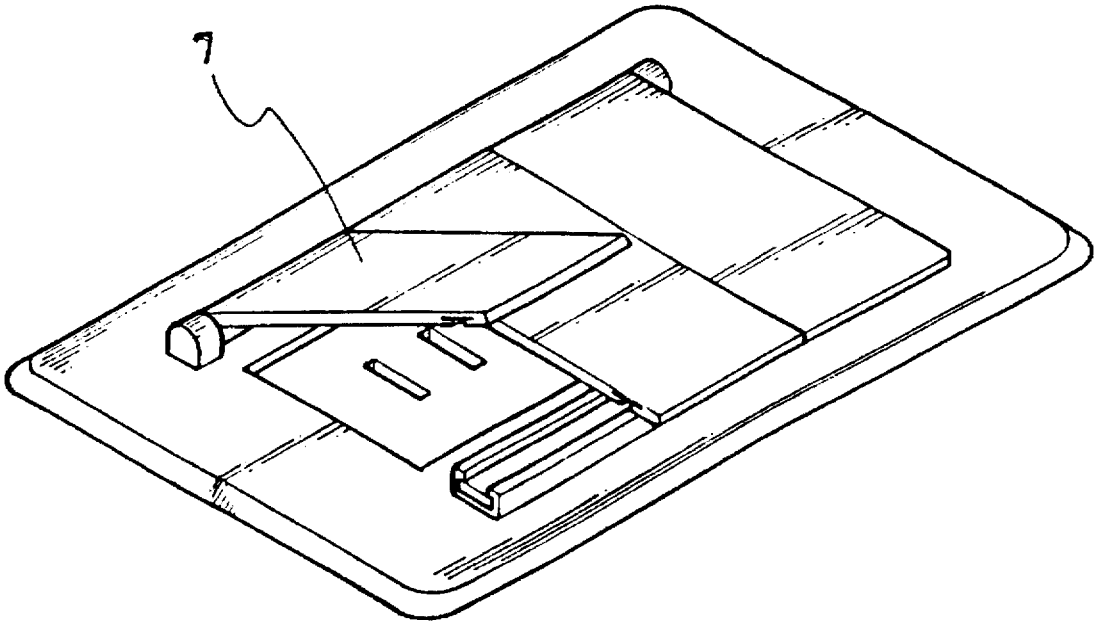
FIG. 5A is a diagram showing the operation of the fourth embodiment of the present invention.

In the fourth embodiment, as shown in FIG. 5, 5A, the top cover 2 is provided with a pair of lugs 51 disposed on one long side of the central opening 21 and an elongated groove 6 in which a magnet strip 61 is placed. Each lug 51 has a retaining hole 511 in which one end of a shaft 5 is inserted. Three door plates 7 each having a tubular holes 73 in which the shaft 5 is located are pivotally engaged with shaft 5. The maganet strip 61 is placed in a groove 6. Each door plate 7 is provided with a receiving groove 72 at the front end thereof in which a magnet 71 is housed so that the door plates 7 can be retained in position by way of the magnet strip 61 and the magnets 71 when the door plates 7 are pivotally closed, as shown in FIG. 5A.

The present invention apparently has the following advantages in practical use:

1. It can be mounted to a a common socket set with ease without removing the whole socket set, only the internal cover of a prior art socket set is taken off.
2. It can effectively prevent a person from being electrically shocked in use of a socket set.
3. It can avoid accumulation of dust in a socket set, causing malfunction of the socket set.
4. It is rather practical in use.
5. It can be manufactured with a low cost.
6. It is easily operated.

I claim:

1. A guard lid for a common household wall-mounted socket set, comprising:

a top cover having a central opening, each corner of one side of said cover being provided with a locking hook having an extended hooking end;

said top cover having a pair of parallel retaining blocks each disposed adjacent one side of said central opening of said top cover;

a telescopic guard lid having a front door plate, a middle door plate, and a rear door plate telescopically interconnected;

a bottom board having a central opening corresponding to said central opening of said top cover;

said bottom board having a three-sided protruding wall disposed about said central opening;

two opposing sides of said three-sided protruding wall having a stepwise inner face so that said door plates of said telescopic guard lid being movable inside said wall;

said front door plate having two spaced protruded dots disposed at two corners thereof, movement of said dots being limited by said retaining blocks, each said retaining block having a downward extension;

said front door plate having a vertical holding wall disposed at one side thereof for easy operation of said front door plate;

said middle door plate also having two spaced protruding dots, said middle door having a pair of parallel grooves disposed on an underside of said middle door plate so that said protruding dots of said front door plate are slidably engaged with said grooves of said middle door plate when said front door plate is disposed under said middle door plate;

said rear door plate having a pair of parallel grooves disposed on an underside of said rear door plate so that said protruding dots of said middle door plate are slidably engaged with said grooves of said rear door plate when said middle door plate is disposed under said rear door plate;

said bottom board is provided with retaining cavities at each corner of said bottom board so that said top cover can be locked to said bottom board with said telescopic guard lid confined therebetween.

2. A guard lid for use on a household socket set as claimed in claim 1 wherein a pair of locking posts, each disposed on one side of said vertical holding wall of said front door plate, are provided so that a pair of bias springs each having one end secured to the locking posts can be engaged with said front door plate; a pair of another locking posts are disposed at one side of said bottom board for the securing of the other end of said bias springs whereby said telescopic guard lid can be retractably moved when a plug is removed from said socket set.

3. A guard lid for use on a household socket set as claimed in claim 1 wherein said bottom board is provided with a plurality of spaced retaining cavities on parallel sides of said central opening; and said front door plate is provided with a pair of projections on an underside of said protruded dots whereby said front door plate can be retained in place at different positions when pushed opened or closed.

4. A guard lid for use on a household socket set, comprising:

a top cover having a central opening;

at one side of said central opening being disposed a pair of spaced lugs each said lug having a retaining hole;

a shaft having each end thereof engaged with said retaining holes of said lugs;

a groove disposed at the opposite side of said lugs for receiving a magnet strip;

a plurality of door plates each having a tubular hole at one side thereof for pivotal engagement with said shaft;

each said door plate having a receiving groove disposed at the other side of said tubular hole for housing a magnet;

whereby said central opening in which said socket set are located can be opened or closed and said door plates retained in locking position by way of magnetic force.

* * * * *